US009863692B2

(12) United States Patent
Moon et al.

(10) Patent No.: US 9,863,692 B2
(45) Date of Patent: Jan. 9, 2018

(54) REFRIGERATOR

(71) Applicant: Samsung Electronics Co., Ltd, Gyeonggi-do (KR)

(72) Inventors: Jae Wook Moon, Gyeonggi-do (KR); Young Jin Cho, Incheon (KR); Dong Hyun Chun, Gyeonggi-do (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/360,953

(22) Filed: Nov. 23, 2016

(65) Prior Publication Data

US 2017/0146286 A1 May 25, 2017

(30) Foreign Application Priority Data

Nov. 24, 2015 (KR) ..... 10-2015-0164563

(51) Int. Cl.
*F25D 25/00* (2006.01)
*F25D 25/02* (2006.01)
*F25D 23/06* (2006.01)

(52) U.S. Cl.
CPC ..... *F25D 25/025* (2013.01); *A47B 2210/175* (2013.01); *F25D 23/067* (2013.01)

(58) Field of Classification Search
CPC .. F25D 25/025; F25D 23/025; F25D 2323/02; A47B 88/40; A47B 88/423; A47B 88/46; A47B 88/463; A47B 88/467; A47B 88/47; A47B 88/473; A47B 2088/4235; A47B 2210/0056; A47B 2210/17; A47B 2210/175
See application file for complete search history.

(56) References Cited

U.S. PATENT DOCUMENTS 7,810,890 B2 * 10/2010 Klein ..... A47B 88/90 312/330.1
2011/0175508 A1 7/2011 Rechberg et al.
2013/0043780 A1 * 2/2013 Ootsuka ..... F25D 25/025 312/402
2013/0300275 A1 * 11/2013 Chellappan ..... F25D 25/025 312/402

(Continued)

FOREIGN PATENT DOCUMENTS

KR 1020070059764 6/2007
KR 1020110046237 5/2011
KR 1020130055178 5/2013

*Primary Examiner* — Daniel J Rohrhoff

(57) ABSTRACT

Disclosed herein are a refrigerator capable of reducing a manufacturing cost by reducing the number of members constituting a sliding apparatus to simplify the sliding apparatus. A refrigerator includes a main body, a storage chamber provided in the inside of the main body, wherein the front part of the storage chamber opens, a storage box accommodated in the storage chamber, and including side surfaces and a bottom surface, a guide rail coupled with the storage box, and configured to guide the storage box to be slidingly pushed into and pulled from the storage chamber and a closing apparatus configured to accumulate an elastic force when the storage box is pulled, and to transfer, when the storage box is pushed, the accumulated elastic force, thereby assisting the pushing of the storage box, wherein the closing apparatus is directly coupled with the bottom surface of the storage box.

16 Claims, 16 Drawing Sheets

(56) References Cited

U.S. PATENT DOCUMENTS

| | | | | |
|---|---|---|---|---|
| 2015/0022072 | A1* | 1/2015 | Haltmeyer | F25D 25/025 312/401 |
| 2016/0138851 | A1* | 5/2016 | Kim | F25D 25/025 312/405 |
| 2016/0296015 | A1* | 10/2016 | Zhu | A47B 88/047 |

* cited by examiner

REFRIGERATOR

CROSS-REFERENCE TO RELATED APPLICATION(S) AND CLAIM OF PRIORITY

This application claims the benefit of Korean Patent Application No. 10-2015-0164563, filed on Nov. 24, 2015 in the Korean Intellectual Property Office, the disclosure of which is incorporated herein by reference.

TECHNICAL FIELD

Embodiments of the present disclosure relate to a refrigerator having a storage unit that is pushed or pulled through a guide rail.

BACKGROUND

In general, a refrigerator is a home appliance including a storage chamber for storing food, and a cool-air supply apparatus for supplying cool air to the storage chamber, to store food fresh.

The inside temperature of the storage chamber is maintained within a specific temperature range required to store food fresh.

The front part of the storage chamber of the refrigerator opens, and the open front part of the storage chamber is closed by a door at ordinary time in order to maintain the inside temperature of the storage chamber.

The storage chamber is partitioned into a plurality of chambers by a partition wall, wherein the upper one of the plurality of chambers is opened or closed by two doors rotatably hinge-coupled with the refrigerator, and the lower one of the plurality of chambers is opened or closed by a storage box slidingly moving back and forth.

The storage box is slidingly pushed into and pulled from the inside of the storage chamber by a sliding apparatus, and the sliding apparatus includes a cover rail disposed at both side walls of the storage chamber, and a sliding rail disposed at both side surfaces of the storage box and guided along the cover rail.

Since the configuration in which the rail structures of the sliding apparatus are disposed on the side surfaces of the storage box operates by installing rollers on the side surfaces of the storage box, the storage box is pulled to a short distance so that a user has difficulties in taking food stored in the storage box.

Also, in order to completely push the storage box into the inside of the storage chamber, the user should push the storage box to the inside end of the storage chamber, and at this time, the storage box makes a noise.

Also, a storage box which a user does not need to push to the inside end of the storage chamber includes a large number of members constituting the sliding apparatus, resulting in high manufacturing costs.

SUMMARY

Therefore, it is an aspect of the present disclosure to provide a refrigerator in which a sliding apparatus is disposed below a storage box so that the storage box can be sufficiently pulled.

It is another aspect of the present disclosure to provide a refrigerator in which a storage box can be easily pushed into the inside of a storage chamber while reducing the generation of noise.

It is still another aspect of the present disclosure to provide a refrigerator capable of reducing a manufacturing cost by reducing the number of members constituting a sliding apparatus to simplify the sliding apparatus.

Additional aspects of the disclosure will be set forth in part in the description which follows and, in part, will be obvious from the description, or may be learned by practice of the disclosure.

In accordance with one aspect of the present disclosure, a refrigerator may include a main body, a storage chamber provided in the inside of the main body, wherein the front part of the storage chamber opens, a storage box accommodated in the storage chamber, and including side surfaces and a bottom surface, a guide rail coupled with the storage box, and configured to guide the storage box to be slidingly pushed into and pulled from the storage chamber and a closing apparatus configured to accumulate an elastic force when the storage box is pulled, and to transfer, when the storage box is pushed, the accumulated elastic force, thereby assisting the pushing of the storage box, wherein the closing apparatus is directly coupled with the bottom surface of the storage box.

The storage box may further include at least one boss member on the bottom surface, and wherein the boss member may provide coupling space to allow the closing apparatus to be directly coupled with the bottom surface.

The refrigerator may further include at least one coupling member passing through one side of the closing apparatus to be coupled with the boss member, thereby coupling the closing apparatus with the storage box.

The boss member may include at least one boss support connecting the outer surface of the boss member to the lower portion of the storage box so that the coupling member is stably coupled with the storage box.

The boss member may be injection-molded with the bottom surface.

The guide rail may include a cover rail fixed at both side walls of the storage chamber, and a sliding rail slidingly moving along the cover rail.

The sliding rail may include a coupling protrusion at one end, and the coupling protrusion may protrude upward in order to couple the storage box with the sliding rail.

The storage box may further include at least one coupling groove at one side, and the coupling protrusion may be inserted into the coupling groove so that the storage box is coupled with the sliding rail.

The refrigerator may further include a coupling portion disposed at both side walls of the storage chamber, and configured to couple the guide rail with the storage chamber, wherein the coupling portion may be integrated into the storage chamber such that the guide rail is slidingly inserted on the coupling portion.

The guide rail may further include a fixing hole into which a fixing member is inserted so that the guide rail is inserted on the coupling portion and then fixed at the coupling portion by the fixing member.

The closing apparatus may include an oil damper configured to absorb an impact generated by an elastic force when the storage box is pushed.

The closing apparatus may further include a case forming the outer appearance of the closing apparatus, a slider configured to perform a reciprocating motion in the inside of the case, a rotator rotatably coupled with the slider, and an elastic member connected to the slider and the case, respectively, at both ends.

The closing apparatus may further include a guide rail in the inside of the case, wherein the guide rail may include a linear path configured to guide the rotator to perform a reciprocating motion, and a catching portion formed at one end of the linear path so that the rotator rotates to be fixed at the catching portion.

The guide rail may further include a catching member, and the rotator may be caught by the catching member when the storage box is pushed and pulled so as to perform a reciprocating motion in a direction in which the storage box moves.

In accordance with one aspect of the present disclosure, a refrigerator may include a main body, a storage chamber provided in the inside of the main body, wherein the front part of the storage chamber opens a storage box accommodated in the storage chamber, and including at least one boss member, a guide rail configured to guide the storage box to be slidingly pushed into or pulled from the storage chamber, a closing apparatus configured to accumulate an elastic force when the storage box is pulled, and to transfer, when the storage box is pushed, the elastic force in a direction in which the storage box is pushed and at least one coupling member configured to pass through one side of the closing apparatus to be coupled with the boss member.

The storage box may further include a bottom surface forming the bottom of the storage box, and the at least one boss member may be integrated into the bottom surface.

The coupling member may be screw-coupled with the boss member to thereby couple the closing apparatus with the storage box.

In accordance with one aspect of the present disclosure, a refrigerator may include a main body, a storage chamber provided in the inside of the main body, wherein the front part of the storage chamber opens, a storage box accommodated in the storage chamber, and including side surfaces and a bottom surface, a guide rail coupled with the storage chamber, and configured to guide the storage box to be slidingly pushed into and pulled from the storage chamber, a closing apparatus configured to accumulate an elastic force when the storage box is pulled, and to transfer, when the storage box is pushed, the elastic force in a direction in which the storage box is pushed, thereby assisting the pushing of the storage box, at least one boss member integrated into the bottom surface and at least one coupling member configured to pass through one side of the closing apparatus to be coupled with the boss member, wherein the coupling member is coupled with the boss member so that the closing apparatus is directly coupled with the bottom surface of the storage box.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
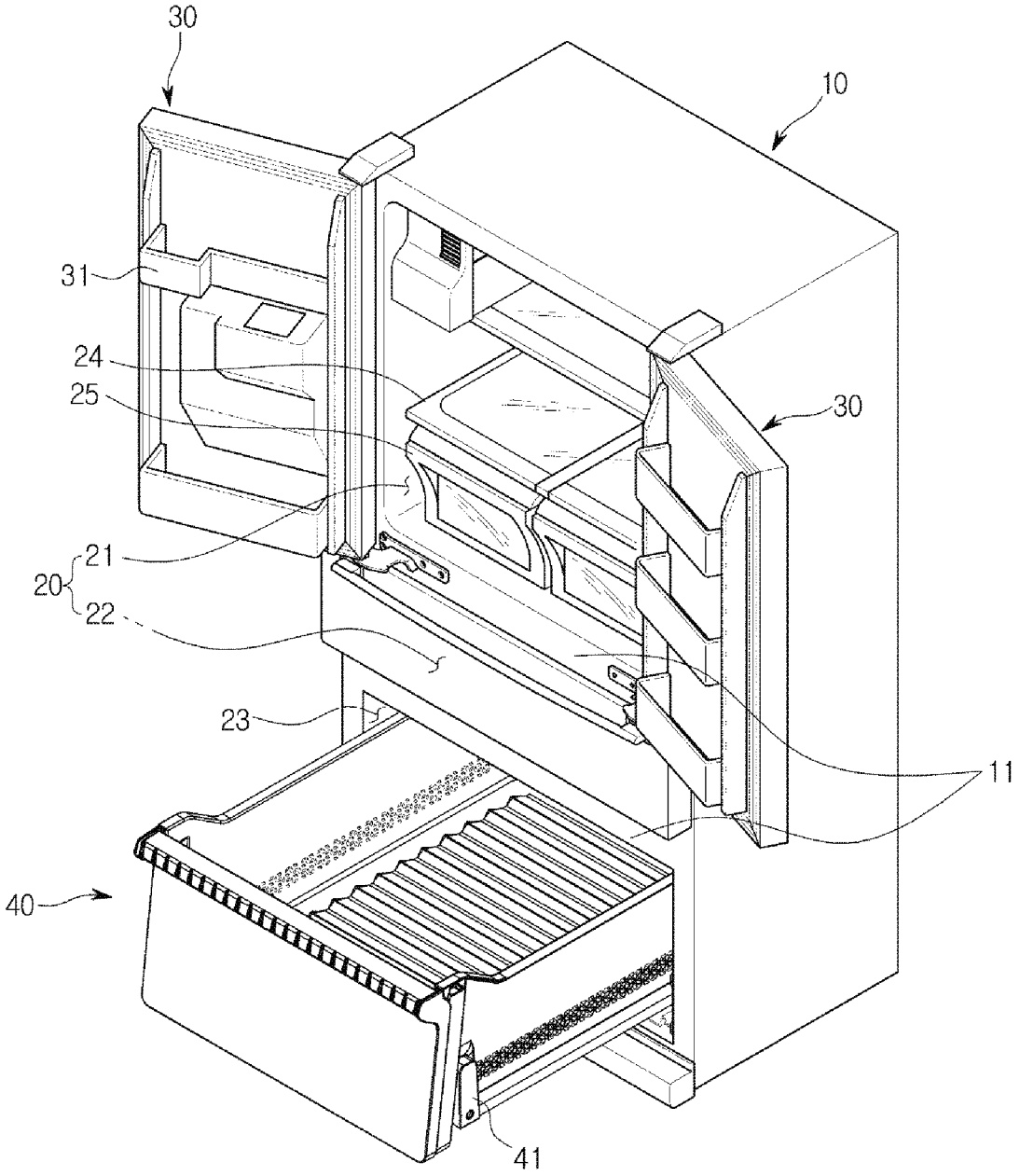
FIG. 1 is a perspective view of a refrigerator in accordance with an embodiment of the disclosure.
Figure 2:
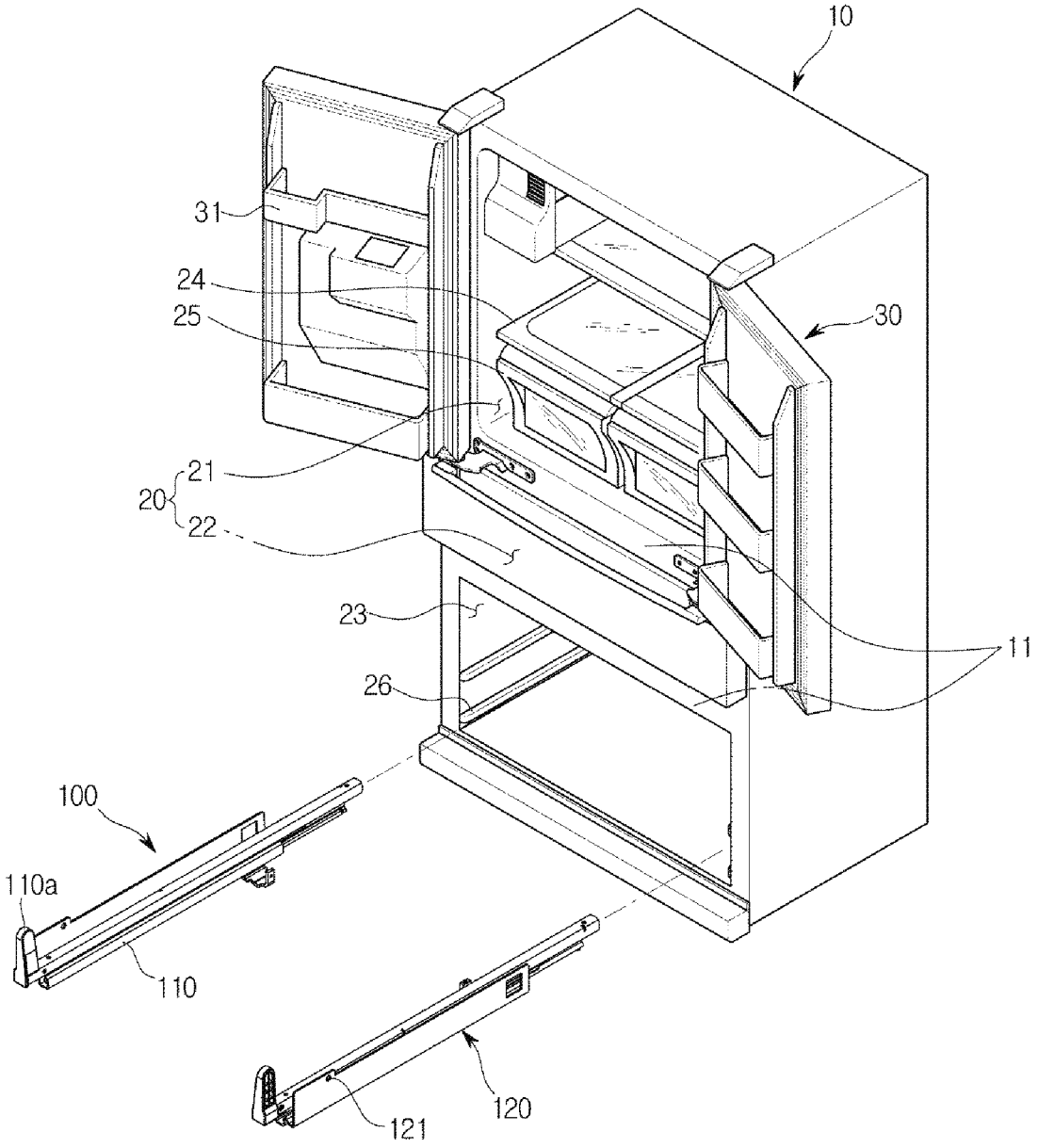
FIG. 2 is a view illustrating a state in which a guide rail of the refrigerator being coupled with a storage chamber in accordance with an embodiment of the disclosure.
Figure 3:
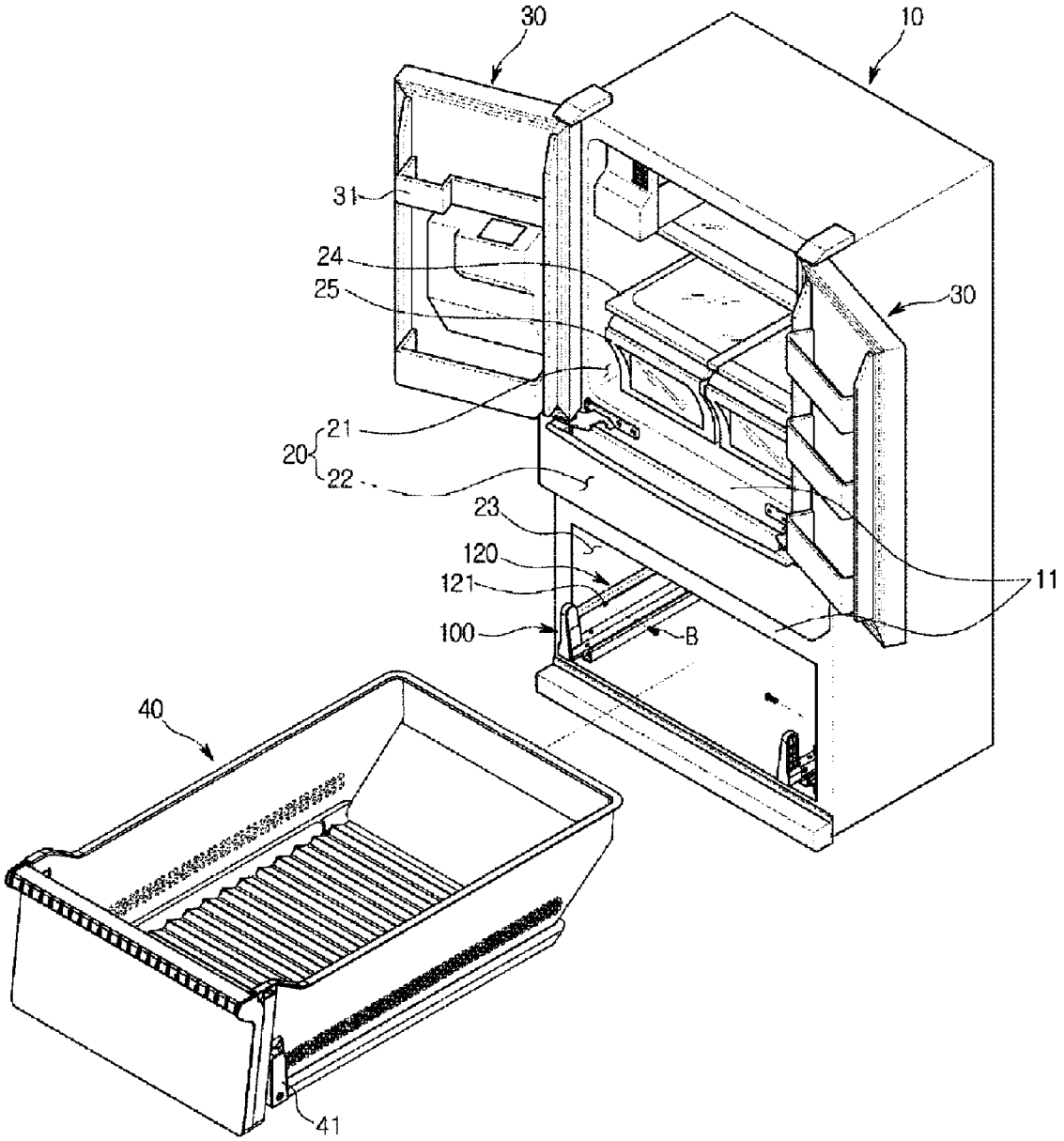
FIG. 3 is a view illustrating a state in which a guide rail of the refrigerator is coupled with a storage chamber in accordance with an embodiment of the disclosure.
Figure 4:
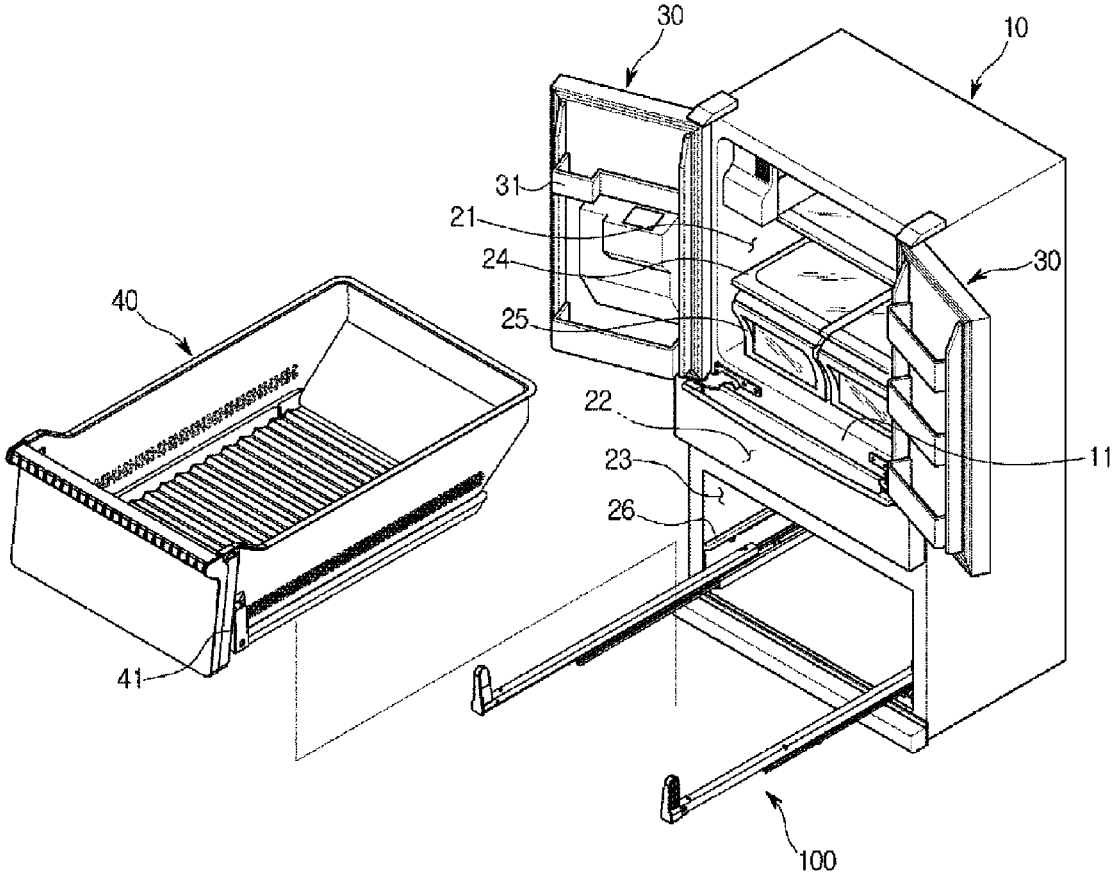
FIG. 4 is a view illustrating a state in which a storage box of the refrigerator being coupled with the guide rail of the refrigerator in accordance with an embodiment of the disclosure.
Figure 5:
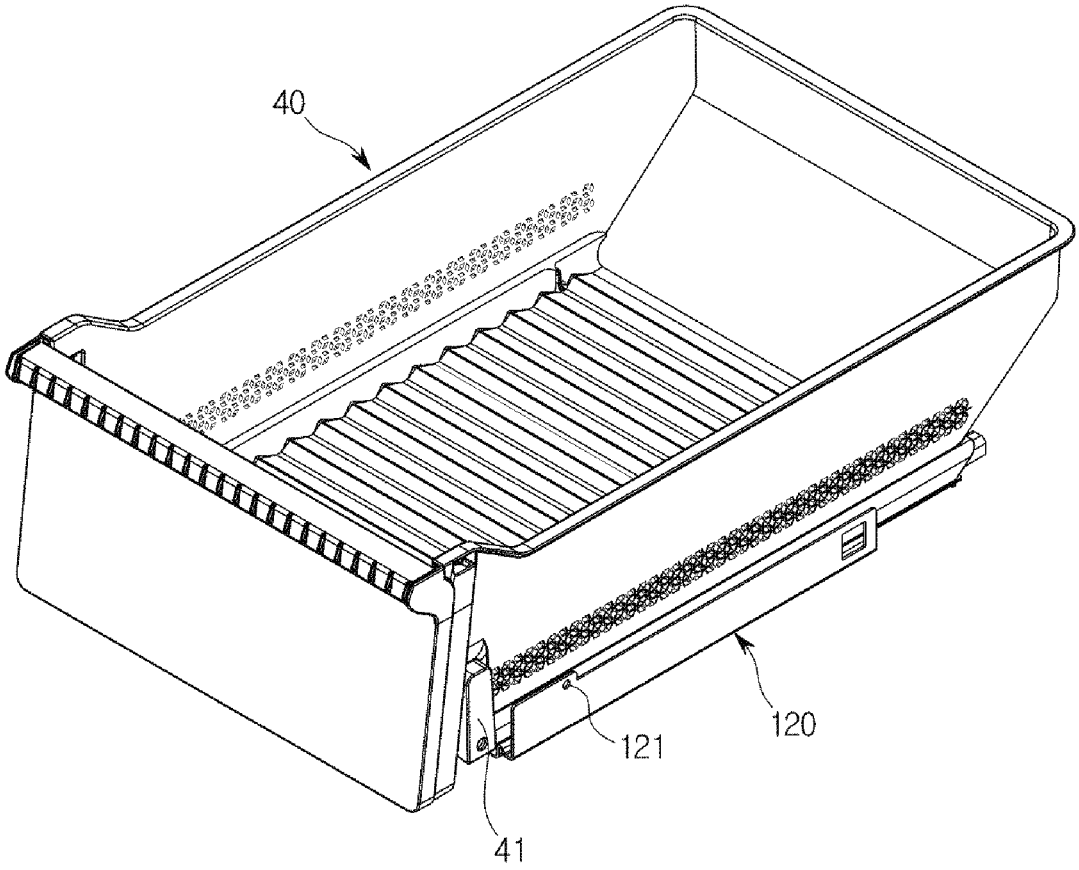
FIG. 5 is a view illustrating a state in which a storage box of the refrigerator is coupled with the guide rail of the refrigerator in accordance with an embodiment of the disclosure.

Hereinafter, preferred embodiments according to the present disclosure will be described in detail with reference to the accompanying drawings. Meanwhile, the terms "front end", "rear end", "upper portion", "lower portion", "upper end", and "lower end", when used in this specification, are defined based on the drawings, and the shapes and locations of the corresponding components are not limited by the terms.

As shown in FIGS. 1 to 7, a refrigerator may include a main body 10, a plurality of storage chambers 20 formed in the inside of the main body 10, wherein the front parts of the storage chambers 20 open, a door 30 rotatably coupled with the main body 10 to open or close the opened front parts of the storage chambers 20, a storage box 40 accommodated in one of the storage chambers 20, and configured to be slidingly pushed into or pulled from the inside of the storage chamber 20, and a guide rail 100 configured to guide the storage box 40 to be slidingly pushed or pulled.

The main body 10 may include an inner case (not shown) forming the storage chambers 20, an outer case (not shown) forming the outer appearance of the refrigerator, and a cool-air supply apparatus (not shown) configured to supply cool air to the storage chambers 20.

The cool-air supply apparatus may include a compressor, a condenser, an expansion valve, an evaporator, a blow fan, a cool-air duct, etc., and an insulator (not shown) for preventing cool air from leaking out may be foamed between the inner case and the outer case of the main body 10.

The storage chambers 20 may be partitioned into a plurality of chambers by a partition wall 11, wherein the plurality of chambers include an upper chamber 21, a middle chamber 22, and a lower chamber 23 arranged vertically to keep food refrigerated or frozen as necessary.

In the upper chamber 21, a plurality of shelves 24 may be provided to partition the upper chamber 21 into a plurality of spaces, and also, a plurality of storage containers 25 may be provided to store food.

The upper chamber 21 may be opened or closed by the door 30 rotatably coupled with the main body 10, and the middle chamber 22 and the lower chamber 23 may be opened or closed by the storage box 40 to slidingly move with respect to the main body 10.

In the rear surface of the door 30, a plurality of door guides 31 may be installed to store food, etc.

The storage box 40 may be slidingly pushed into or pulled from the inside of the middle chamber 22 or the lower chamber 23 through the guide rail 100.

For convenience of description, the storage box 40 is assumed to be a storage box that is pushed into or pulled from the inside of the lower chamber 23, and the guide rail 100 is also assumed to be a guide rail coupled with the storage box 40 that is pushed into or pulled from the inside of the lower chamber 23.

The guide rail 100 may be coupled with the inner surface of the storage chamber 20, and enable the storage box 40 to be pushed into or pulled from the inside of the storage chamber 20.

The guide rail 100 may include a cover rail 120 fixed at both side walls of the storage chamber 20, and a sliding rail 110 configured to slidingly move along the cover rail 120. The sliding rail 110 may be installed in the inside of the cover rail 120 to slidingly move along the cover rail 120.

At both side walls of the storage chamber 20, a coupling portion 26 may be disposed to be coupled with the cover rail 120. The coupling portion 26 may be integrated into both side walls of the storage chamber 20.

The coupling portion 26 may be configured such that the cover rail 120 can be slidingly inserted on the coupling portion 26.

The guide rail 100 may be installed by slidingly pushing the cover rail 120 on the coupling portion 26, and then inserting a fixing member B into a fixing hole 121 formed in the cover rail 120 to thus couple the cover rail 120 with the coupling portion 26. More specifically, the cover rail 120 of the guide rail 100 may be pushed on the coupling portion 26 until the fixing hole 121 formed in the cover rail 120 matches with a coupling hole (not shown) of the coupling portion 26, and then the fixing member B may be inserted into the fixing hole 121 and screw-coupled with the fixing hole 121. In this way, the cover rail 120 of the guide rail 100 may be installed on the coupling portion 26.

Now, operation of coupling the storage box 40 with the guide rail 100 will be described. If the cover rail 120 is coupled with the coupling portion 26, the sliding rail 110 may be pulled out of the storage chamber 10, and then a coupling protrusion 110*a* formed in the sliding rail 110 may be inserted into a coupling groove 41 of the storage box 40, thereby coupling the storage box 40 with the guide rail 100. That is, the storage box 40 may be coupled with the sliding rail 110 by inserting the coupling protrusion 110*a* into the coupling groove 41.

If the storage box 40 is coupled with the sliding rail 110, the sliding rail 110 can be slidingly guided along the cover rail 120 so as to push and pull the storage box 40 into and from the inside of the storage chamber 20.

Since the guide rail 100 is coupled with the lower portion of the storage box 40, the storage box 40 can be pulled completely out of the storage chamber 20, compared to a structure in which rollers are installed on the sides of the storage box 40. Accordingly, a user can easily take food, etc. stored in the storage box 40 out of the storage box 40.

Then, the configuration of the guide rail 100 will be described in detail.

As shown in FIGS. 1 to 7, the guide rail 100 may include the cover rail 120 coupled with both side walls of the storage chamber 20, and the sliding rail 110 configured to slidingly move along the cover rail 120.

In the front portion of the sliding rail 110, the coupling protrusion 110*a* may be formed to protrude upward in order to couple the sliding rail 110 with the storage box 40, and in the storage box 40, the coupling groove 41 may be formed in correspondence to the coupling protrusion 110*a* so that the coupling protrusion 110*a* is inserted into the coupling groove 41. As described above, by inserting the coupling protrusion 110*a* into the coupling groove 41, the storage box 40 may be coupled with the sliding rail 110.

The cover rail 120 may be coupled with and fixed at the coupling portion 26 so as to guide the storage box 40 to be slidingly pushed into or pulled from the inside of the storage chamber 20, as described above.

As shown in FIGS. 6 to 12, a closing apparatus 130 may be coupled with the lower portion of the storage box 40. The closing apparatus 130 may include a case coupled with the lower portion of the storage box 40 and forming the outer appearance of the closing apparatus 130, an elastic unit 150 installed in the inside of the case 140, and configured to accumulate an elastic force when the storage box 40 is pulled and to transfer, when the storage box 40 is pushed, the elastic force in a direction in which the storage box 40 is pushed, and an oil damper 160 coupled with the elastic unit 150, and configured to absorb an impact generated when the storage box 40 is pushed.

Figure 6:
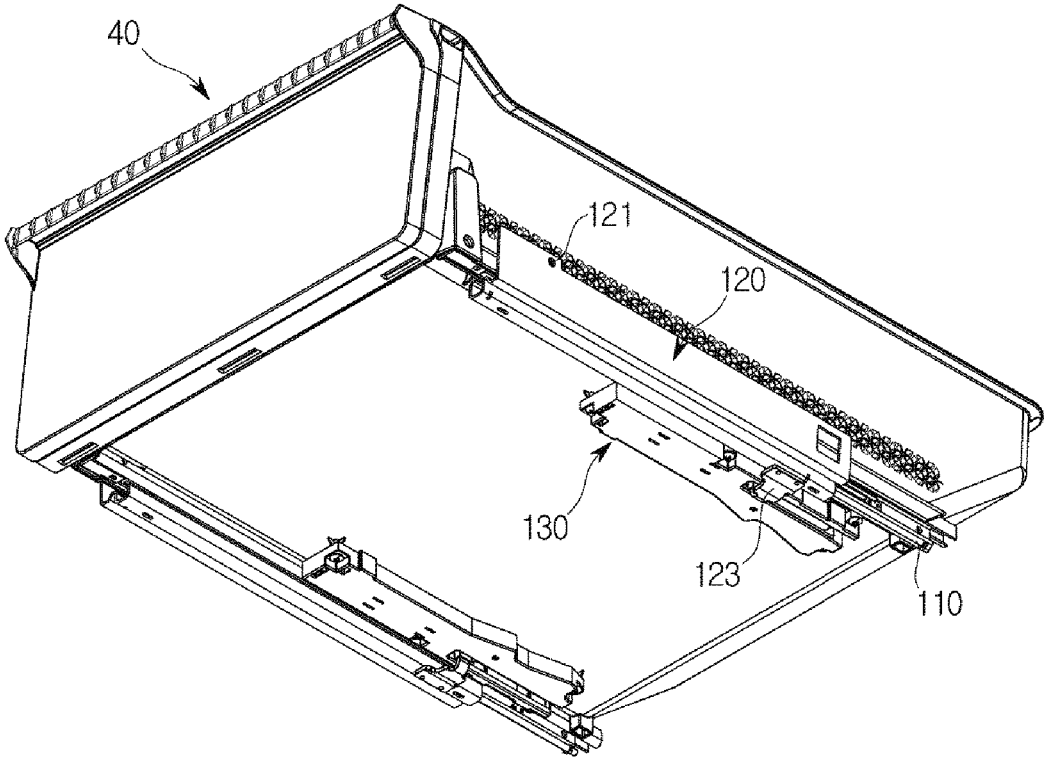
FIG. 6 is a bottom view of the storage box of the refrigerator and the guide rail of the refrigerator in accordance with an embodiment of the disclosure.
Figure 7:
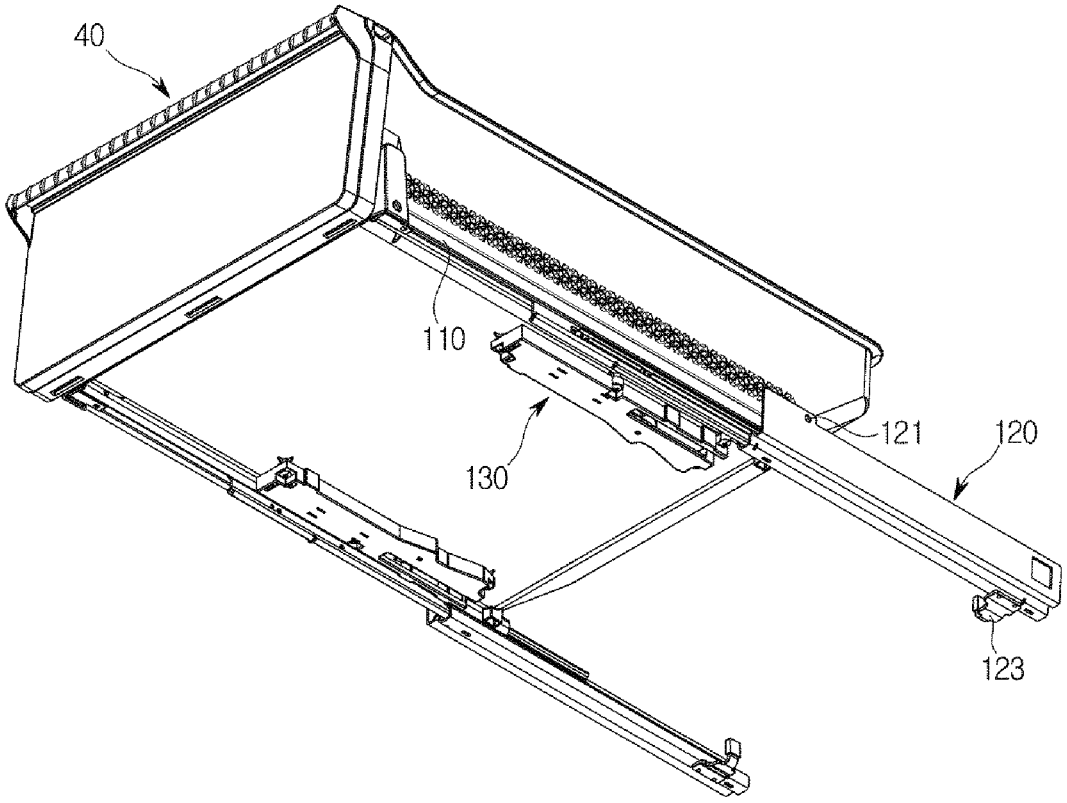
FIG. 7 is a view illustrating a state in which a sliding rail is pulled from a cover rail in the refrigerator of FIG. 6.
Figure 8:
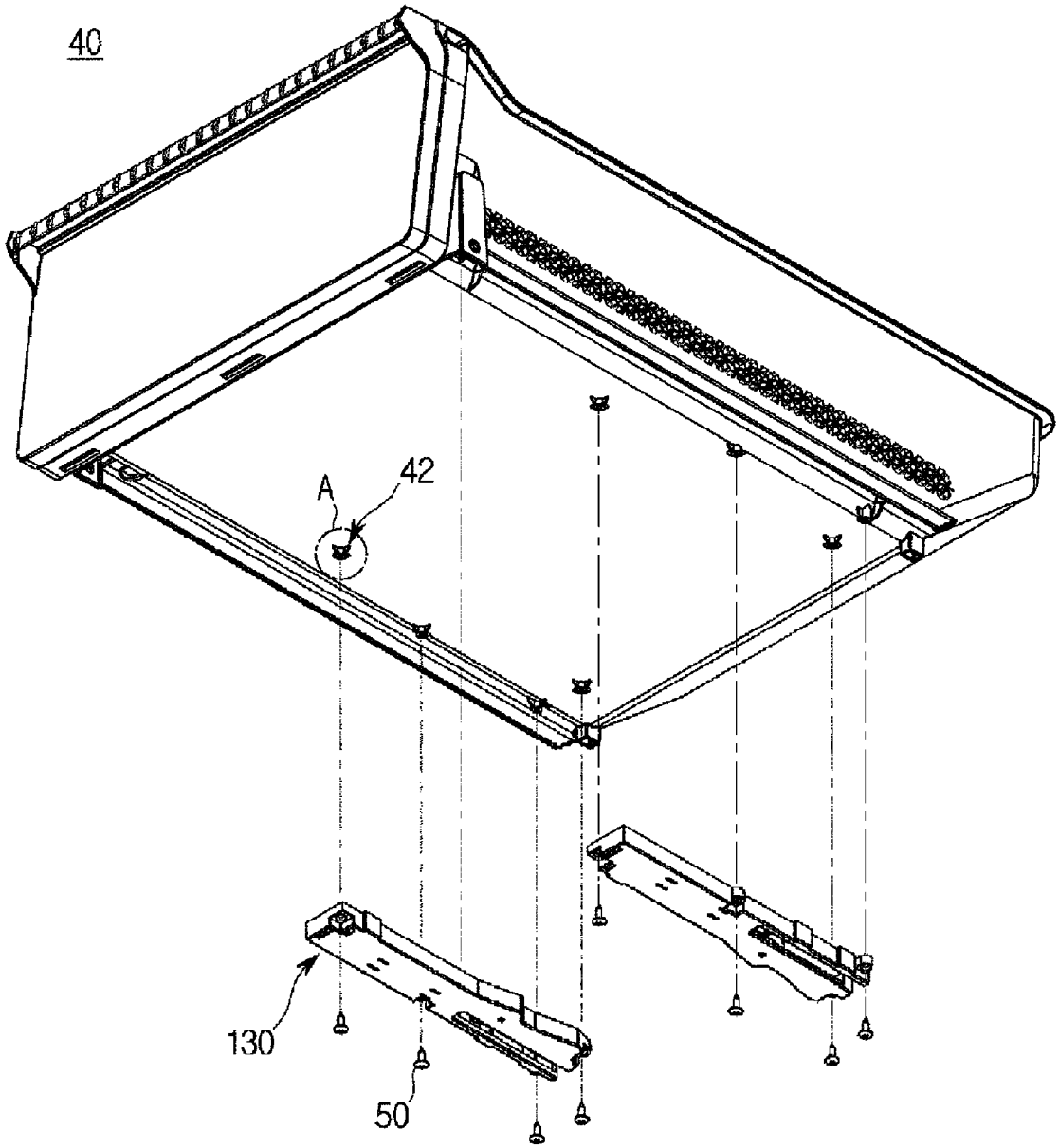
FIG. 8 is a view illustrating a state in which a closing apparatus of the refrigerator is disassembled from the storage box of the refrigerator in accordance with FIG. 9 is an enlarged view of a part A of FIG. 8.
Figure 9:
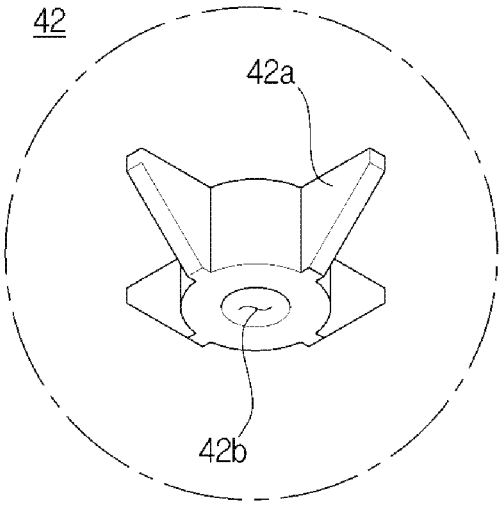
Figure 10:
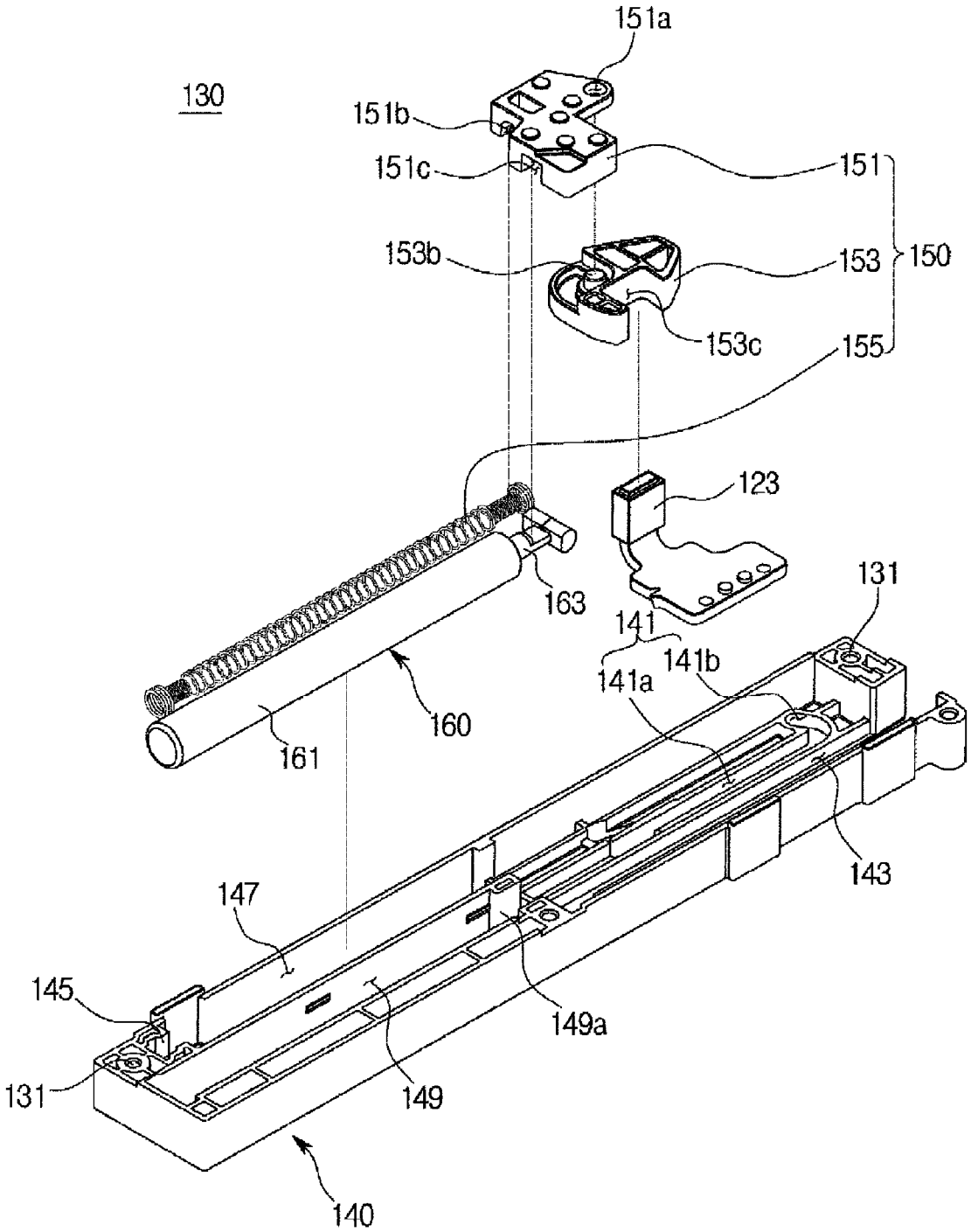
FIG. 10 is a exploded perspective view of the closing apparatus in accordance with an embodiment of the disclosure.

As shown in FIGS. 6, 7, and 9, the closing apparatus 130 may be directly coupled with the bottom surface of the storage box 40.

The storage box 40 may have side surfaces and a bottom surface, and the upper part of the storage box 40 may open.

On the bottom surface forming the bottom of the storage box 40, at least one boss member 42 may be disposed to directly couple the closing apparatus 130 with the bottom surface of the storage box 40. The boss member 42 may be integrated into the bottom surface of the storage box 40. For example, the boss member 42 may be injection-molded with the bottom surface of the storage box 40.

The boss member 42 may include coupling space 42*b* which a coupling member 50 can be inserted into and coupled with. Also, the boss member 42 may include at least one boss support 42*a* at the outer surface to be stably coupled with the coupling member 50.

The boss support 42*a* may have a shape connecting the boss member 42 to the bottom surface. The boss support 42*a* can function to increase a coupling force between the boss member 42 and the coupling member 50. That is, the boss member 42 can stably support even the heavier closing apparatus 130 through the boss support 42*a*, compared to when it includes no boss support 42*a*.

The boss support 42*a* may extend in four directions with respect to the boss member 42, as shown in FIG. 9. That is, when seen from the bottom surface of the storage box 40, the boss support 42*a* may extend in the up, down, left, and right direction of the boss member 42.

Hereinafter, operation of directly coupling the closing apparatus 130 with the bottom surface of the storage box 40 will be described.

The closing apparatus 130 may include at least one through hole 131 through which the coupling member 50 can pass, at the edge. The through hole 131 may be formed in correspondence to the boss member 42.

The closing apparatus 130 may be placed on the bottom surface of the storage box 40 such that the through hole 131 faces the boss member 42, and then the coupling member 50 may pass through the through hole 131 to be coupled with the boss member 42. Thereby, the closing apparatus 130 can be coupled with the bottom surface of the storage box 40.

Since any other member is not needed except for the coupling member 50 and the boss member 42 disposed on the bottom surface of the storage box 40 in order to couple the closing apparatus 130 with the bottom surface of the storage box 40, the closing apparatus 130 can be directly coupled with the storage box 40. That the closing apparatus 130 is directly coupled with the storage box 40 means that any other member for coupling the closing apparatus 130 with the storage box 40 is not needed except for the boss member 42 and the coupling member 50. That is, a component, such as a connection member or an auxiliary member, which may be installed between the closing apparatus 130 and the storage box 40, may be replaced by the boss member 42. Thereby, the number of members constituting the storage box 40 with the closing apparatus 130 can be reduced. Also, since the number of members constituting the storage box 40 is reduced, the configuration of the storage box 40 can be simplified, resulting in a reduction of manufacturing costs.

The coupling member 50 may be screw-coupled with the boss member 42. Accordingly, in the coupling space 42*b* of the boss member 42, threads may be formed. However, the coupling member 50 and the boss member 42 may have any other structures as long as they can be coupled with each other.

The elastic unit 150 may include a slider 151 to move linearly in the inside of the case 140, a rotator 153 rotatably coupled with the slider 151, and an elastic member 155 connected to the slider 151 and the case 140 at both ends.

The slider 151 may include a rotation hole 151*a* with which a rotation shaft 153*b* formed in the rotator 153 is rotatably coupled, a first fixing groove 151*b* at which the elastic member 155 is fixed, and a second fixing groove 151*c* at which the oil damper 160 is fixed.

The slider 151 may perform a linear reciprocating motion together with the rotator 153 along the guide rail 141, which will be described later, and when the slider 151 performs a linear reciprocating motion, the elastic member 155 fixed at the first fixing groove 151*b* of the slider 151 may extend to accumulate an elastic force.

The rotator 153 may include a protrusion 153*a* formed on the bottom of the rotator 153 to protrude downward and be accommodated in the guide rail 141 so that the rotator 153 can be guided along the guide rail 141, the rotation shaft 153*b* to rotatably couple the rotator 153 with the slider 151, and a catching groove 153*c* to accommodate a catching member 123 formed in the cover rail 120 such that the catching member 123 is caught by the catching groove 153*c*.

The protrusion 153*a* may be formed on the bottom of the rotator 153 to protrude toward the guide rail 141, and may move along the guide rail 141 so as for the rotator 153 to be guided along the guide rail 141.

The rotation shaft 153*b* may be formed on the upper surface of the rotator 153, and rotatably coupled with the rotation hole 151*a* of the slider 151.

The rotator 153 may rotate on the rotation shaft 153*b* by the rotation shaft 153*b*. The rotator 153 may move linearly to a predetermined area together with the slider 151, and then rotate.

The catching groove 153*c* may be configured to catch the catching member 123 formed in the cover rail 120, so that the rotator 153 moving together with the storage box 40 when the storage box 40 is pushed or pulled can move along the guide rail 141.

Since the catching member 123 formed in the cover rail 120 fixed at the coupling portion 26 of the storage chamber 20 is maintained at a fixed state, the rotator 153 may move along the guide rail 141 if the catching member 123 is caught by the catching groove 153*c* of the rotator 153 when the storage box i40 is pushed or pulled.

The elastic member 155 may be a spring, and both ends of the elastic member 144 may be fixed at the case 140 and the slider 151, respectively.

The end of the elastic member 155 fixed at the case 140 may be maintained at the fixed state, and the end of the elastic member 155 fixed at the slider 151 may move together with the slider 151 when the slider 151 moves linearly, to extend and then return to the original state, thereby transferring an elastic force to the storage box 40.

The case 140 may be disposed below the storage box 40 to form the outer appearance of the storage box 40, and in the inside of the case 140, the elastic unit 150 and the oil damper 160 may be accommodated.

In the inside of the case 140, the guide rail 141 to accommodate and move the protrusion 153*a* of the rotator 153, a guide portion 143 being a passage through which the catching member 123 moving together with the rotator 153 moves, a fixing portion 145 at which the elastic member 155 is fixed, a first accommodating portion 147 to accommodate the elastic member 155, and a second accommodating portion 149 to accommodate the oil damper 160 may be provided.

The guide rail 141 may be configured to accommodate and move the protrusion 153*a* formed in the rotator 153, as described above, thus guiding the rotator 153 and the slider 151.

The guide rail 141 may include a linear path 141*a* to guide the rotator 153 to perform a linear reciprocating motion in a back-and-forth direction, and a catching portion 141*b* formed at one end of the linear path 141*a* to rotate and fix the rotator 153.

Hereinafter, operation in which the rotator 153 is guided along the guide rail 141 to perform a linear reciprocating motion and a rotation motion will be described.

The guide portion 143 may be disposed in parallel with the linear path 141*a* of the guide rail 141 to guide the catching member 123 caught by the catching groove 153*c* of the rotator 153 and moving together with the rotator 153 to move linearly.

The oil damper 160 may include a body portion 161 that is filled with oil and accommodated in the second accommodating portion 149 of the case 140, and a movable portion 163 accommodated in the inside of the body portion 161 and having one end fixed at the second fixing groove 151*c* of the slider 151.

Since one end of the movable portion 163 is fixed at the slider 151, the movable portion 163 may move together with the slider 151.

Since the slider 151 moves in the same direction as the storage box 40 together with the storage box 40 when the storage box 40 is pushed or pulled, the movable portion 163 may be pushed into the inside of the body portion 161 when the storage box 40 is pushed, and when the storage box 40 is pulled, the movable portion 163 may also be pulled to the outside of the body portion 161 from the inside of the body portion 161.

Since the oil filled in the inside of the body portion 161 absorbs an impact when the movable portion 163 is pulled from the inside of the body portion 161 and then pushed into the inside of the body portion 161, a rapid movement of the elastic unit 150 generated by the elastic force of the elastic unit 150 when the storage box 40 is pushed can be prevented.

That is, since an impact generated when the storage box 40 is rapidly pushed by the elastic force of the elastic unit 150 is absorbed, a noise can be reduced.

In the second accommodating portion 149, a catching protrusion 149*a* may be formed so that the body portion 161 can be accommodated and maintained in the inside of the second accommodating portion 149 of the case 140, while only the movable portion 163 can move together with the slider 151 to be pushed into or pulled from the inside of the body portion 161.

The catching protrusion 149*a* may form space through which the body portion 161 cannot pass and the movable portion 163 can pass, so that the body portion 161 is caught by the catching protrusion 149*a* and prevented from moving, when the movable portion 163 moves together with the slider 151.

Hereinafter, operation of the closing apparatus 130 when the storage box 40 is pushed or pulled will be described with reference to FIGS. 13 to 16.

Figure 13:
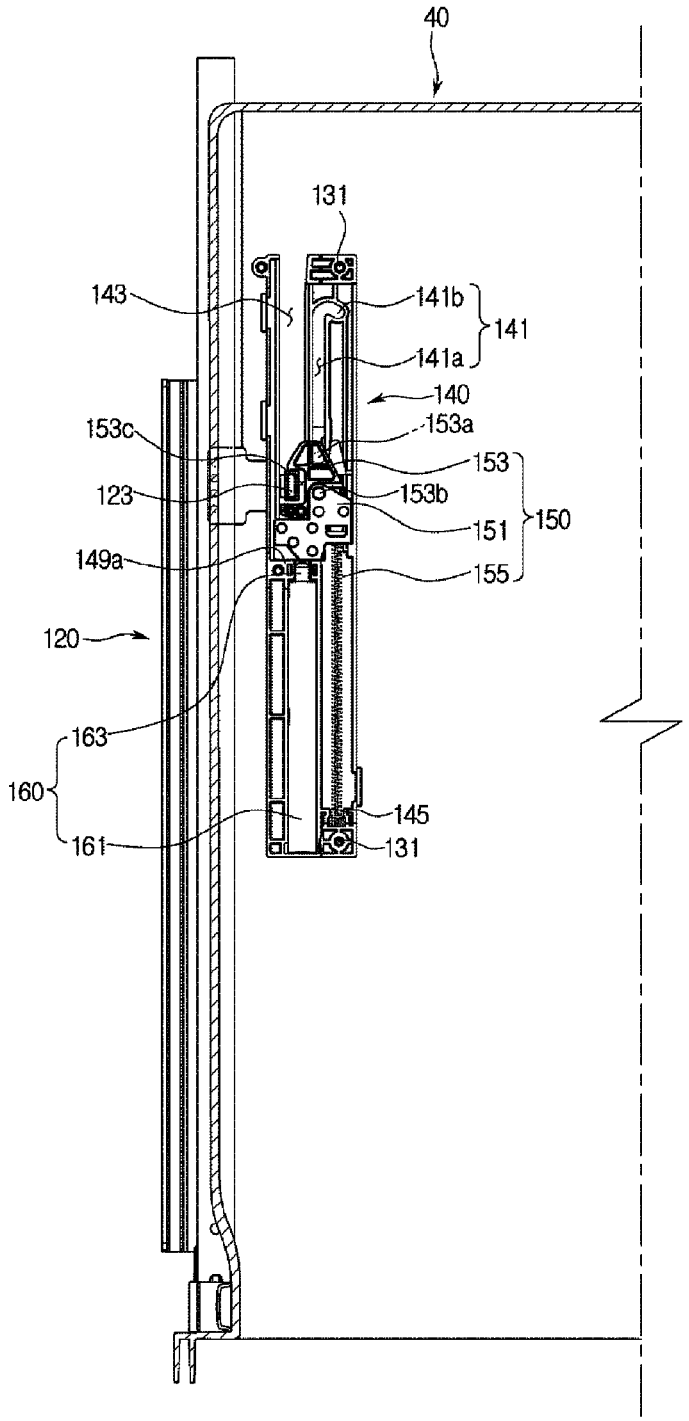
FIG. 13 is a view illustrating a state in which a storage box of the refrigerator is pushed into the storage chamber of the refrigerator in accordance with an embodiment of the disclosure.

As shown in FIG. 13, when the storage box 40 is positioned in the storage chamber 20, the catching member 123 formed in the cover rail 120 may be caught by the catching groove 153*c* of the rotator 153.

Before the rotator 153 moves, the elastic member 155 may be maintained at its original state without extending, and the movable portion 163 of the oil damper 160 may also be positioned in the inside of the body portion 161.

Figure 14:
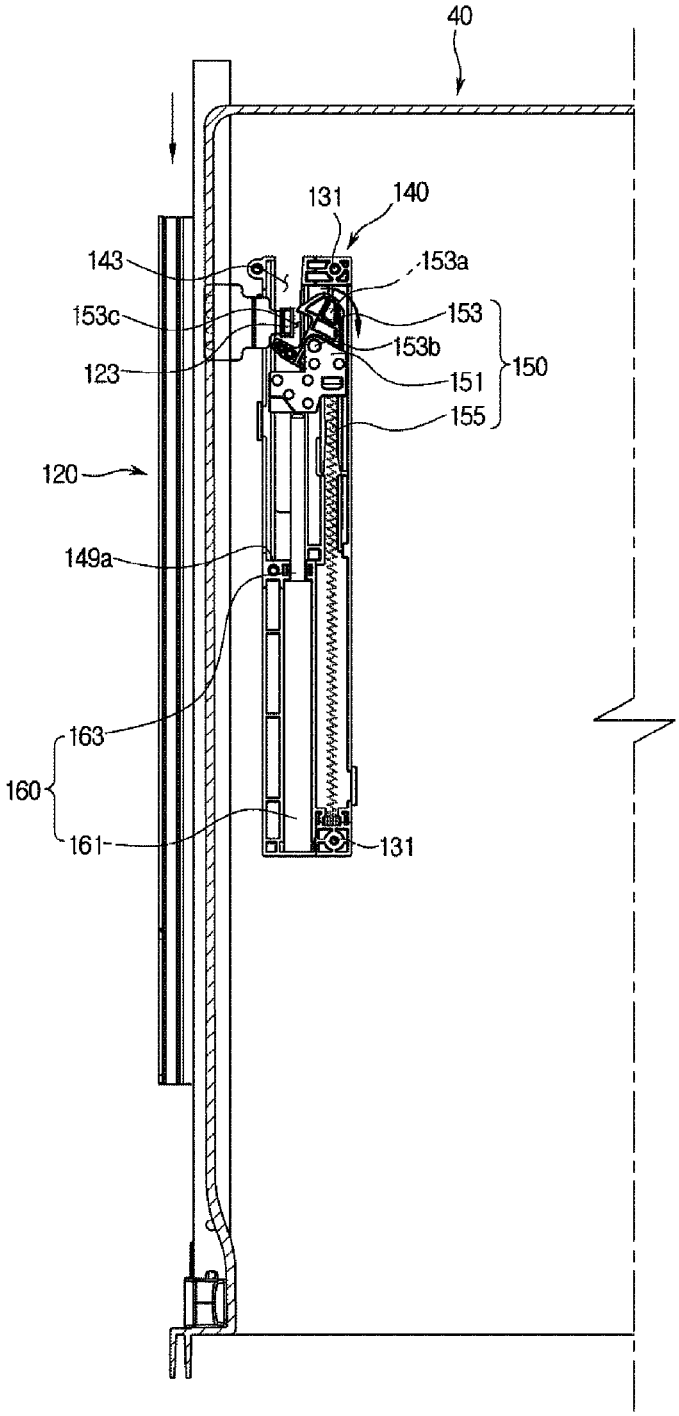
FIGS. 14 and 15 are views illustrating an operation of a storage box that is being pulled from the refrigerator in accordance with an embodiment of the disclosure.

As shown in FIG. 14, when the storage box 40 is pulled, the rotator 153 moving together with the storage box 40 may move backward along the linear path 141*a* of the guide rail 141 by the catching member 123 caught by the catching groove 153*c* of the rotator 153 and fixed at the cover rail 120.

Since the protrusion 153 a formed in the rotator 153 moves along the linear path 141*a* in the state in which it is accommodated in the linear path 141*a*, the rotator 153 may also move along the linear path 141*a* without escaping from the linear path 141*a*.

When the rotator 153 moves backward along the linear path 141*a*, the catching member 123 may move along the guide portion 143 together with the rotator 153 in the state in which it is caught by the catching groove 153*c* of the rotator 153.

When the rotator 153 moves backward along the linear path 141*a*, the slider 151 connected to the rotator 153 may also move together with the rotator 153, so that the elastic member 155 connected to the slider 151 extends to accumulate an elastic force.

Also, the movable portion 163 of the oil damper 160 may move together with the slider 151 to be pulled from the inside of the body portion 161.

The rotator 153 moving along the linear path 141*a* may be rotatably coupled with the slider 151 by the rotation shaft 153*b*, and the protrusion 153*a* may move to the catching portion 141*b* formed at the end of the linear path 141*a* to rotate on the rotation shaft 153*b*.

If the rotator 153 is caught by the catching portion 141*b* and fixed, the elastic member 155 may be maintained at the extended state without further extending, and the movable portion 163 of the oil damper 160 may also be no longer pulled from the body portion 161.

Figure 15:
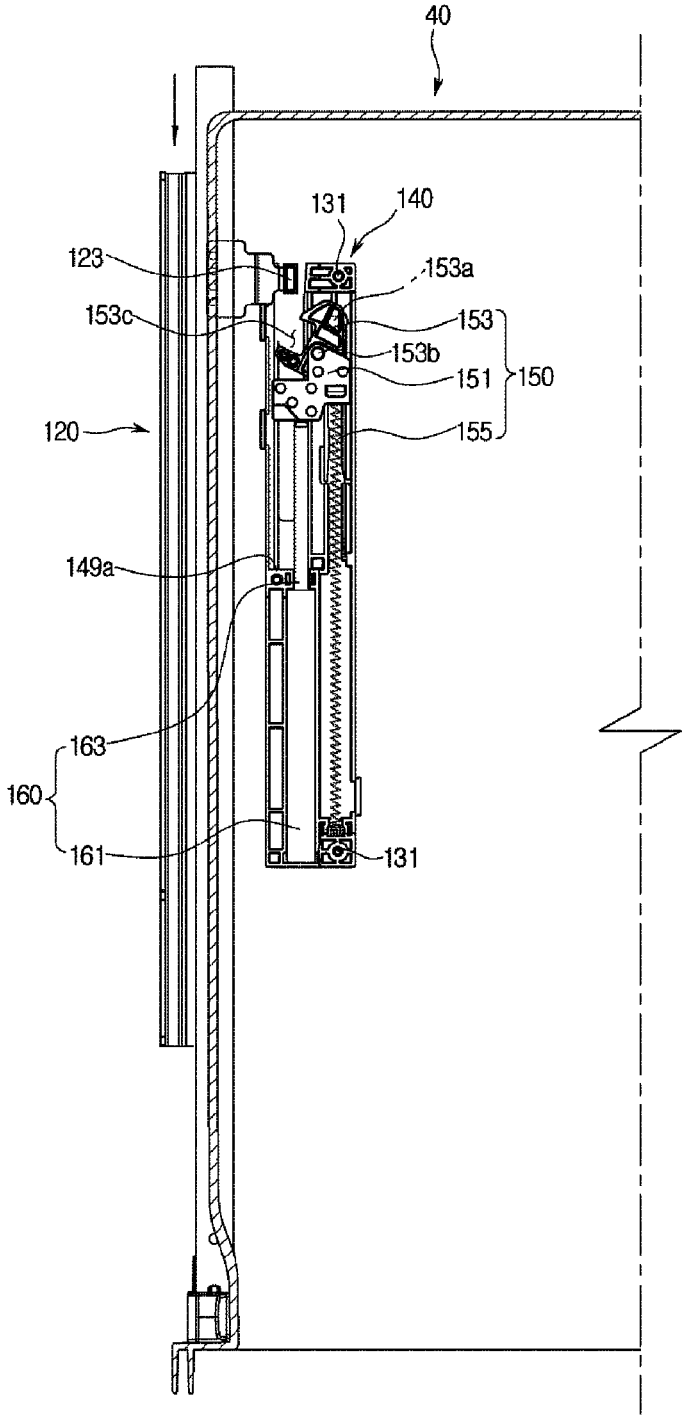

As shown in FIG. 15, if the storage box 40 is pulled in the state in which the rotator 153 is caught by the catching portion 141*b*, the catching member 123 may escape from the catching groove 153*c* when the rotator 153 rotates to be caught by the catching portion 141*b*. Accordingly, the rotator 153 may be maintained in the state in which it is caught by the catching portion 141*b*, and only the catching member 123 escaped from the catching groove 153*c* may move along the guide portion 143.

Figure 16:
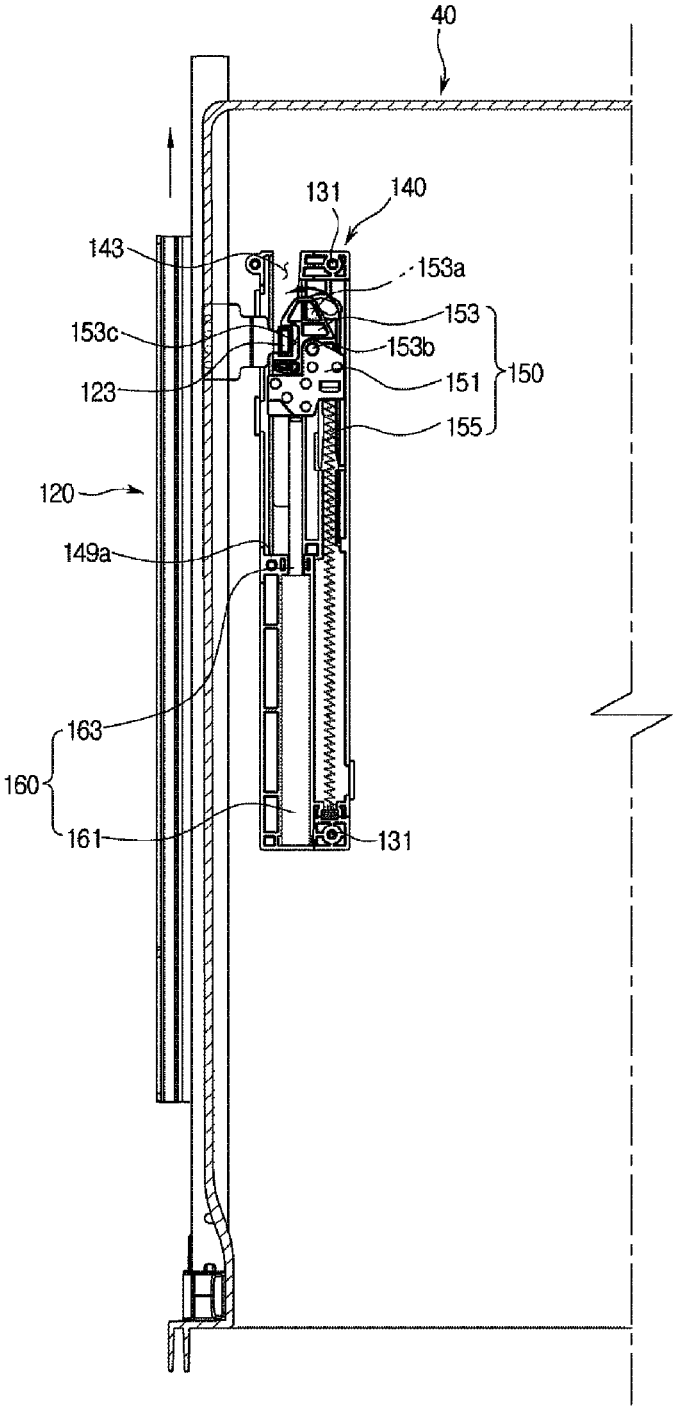
FIG. 16 is a view illustrating an operation of a storage box that is being pushed into the refrigerator in accordance with an embodiment of the disclosure.

As shown in FIG. 16, if the storage box 40 is pushed, the catching member 123 may move forward along the guide portion 143 to be caught by the catching groove 153*c* of the rotator 153.

If the catching member 123 is caught by the catching groove 153*c* of the rotator 153, the rotator 153 may rotate on the rotation shaft 153*b* to thus escape from the catching portion 141*b*.

Figure 11:
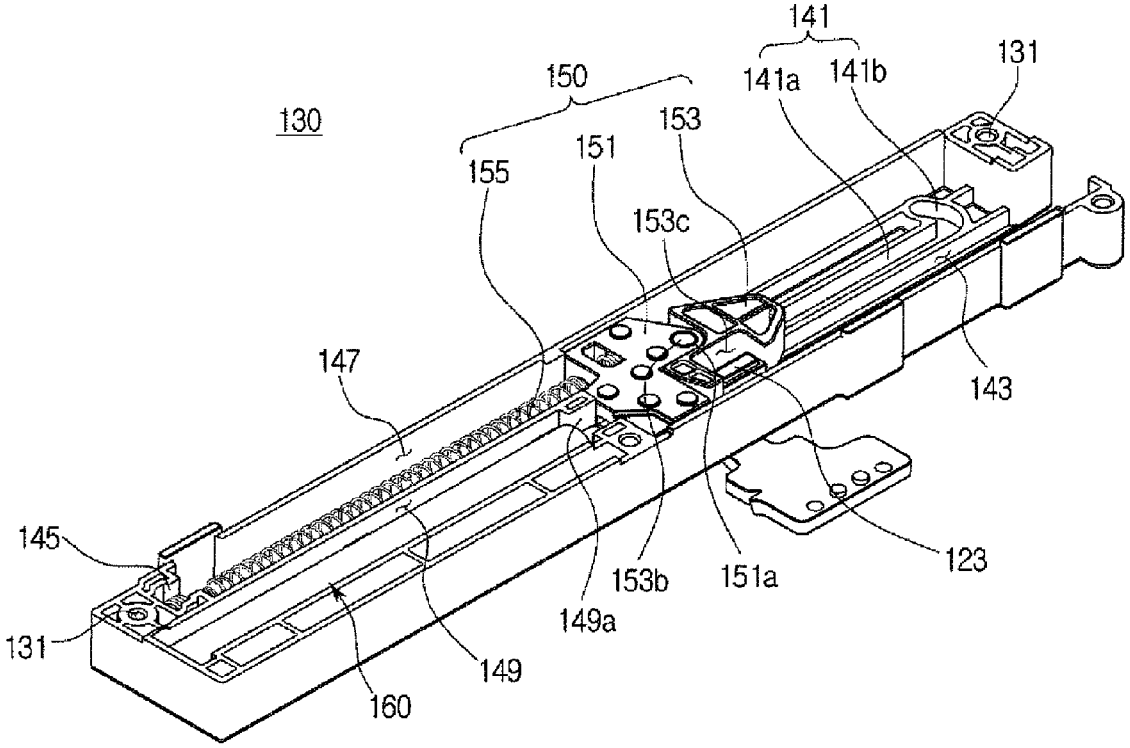
FIG. 11 is a view of the closing apparatus of the refrigerator in accordance with an embodiment of the disclosure.
Figure 12:
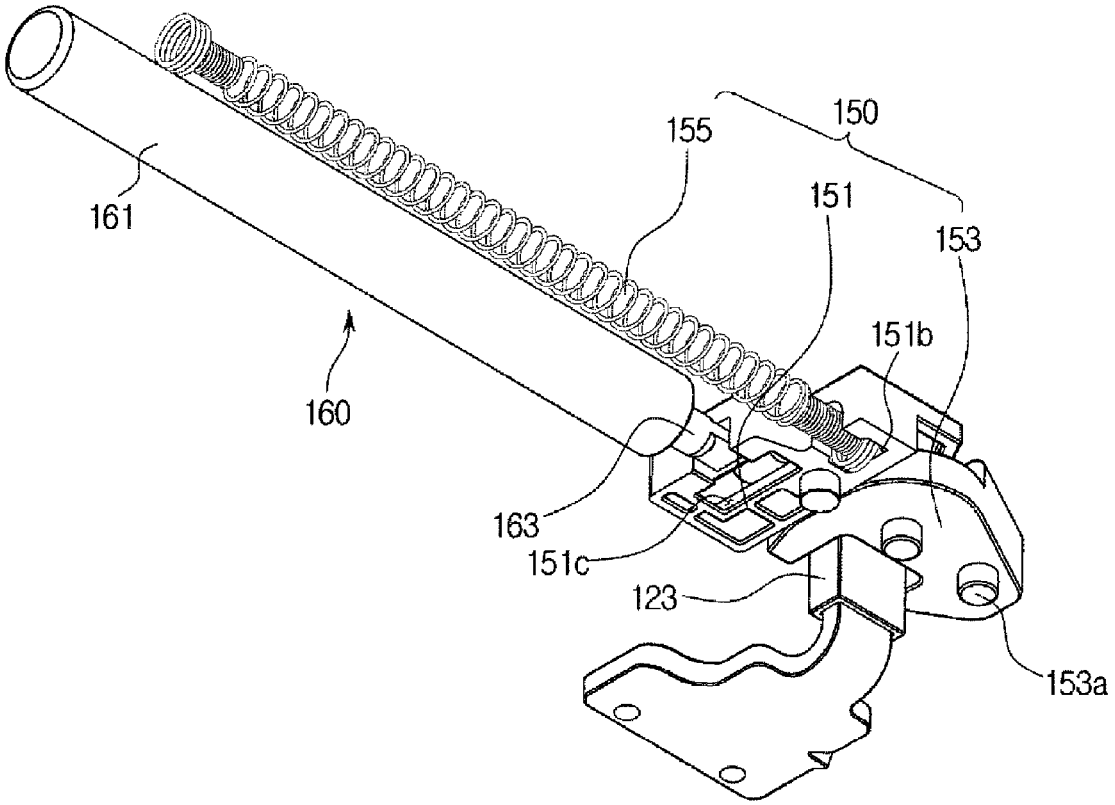
FIG. 12 is a bottom view of a portion of the closing apparatus in accordance with an embodiment of the disclosure.

The rotator 153 escaped from the catching portion 141*b* may move forward along the linear path 141*a* together with the catching member 123 so as to return to the state as shown in FIG. 11.

When the rotator 153 moves forward along the linear path 141*a*, the rotator 153 may move forward by the elastic force of the elastic member 155, so that the storage box 40 can be easily pushed into the inside of the storage chamber 20 although a user pushes the storage box 40 with a small force.

When the rotator 153 moves forward by the elastic force of the elastic member 155, the movable portion 163 of the oil damper 160 may be pushed into the inside of the body portion 161.

When the movable portion 163 is pushed into the inside of the body portion 161, an impact of the storage box 40 pushed by the elastic force can be absorbed by the oil filled in the inside of the body portion 161.

According to an aspect of the present disclosure, since the storage box is sufficiently pulled, a user can easily take food stored in the storage box out of the storage box.

According to another aspect of the present disclosure, the storage box can be easily pushed with a small force, and an impact generated by an elastic force when the storage box is pushed can be absorbed, resulting in a reduction of a noise while preventing a rapid movement of the storage box due to the elastic force.

According to still another aspect of the present disclosure, the number of members constituting the sliding apparatus can be reduced to simplify the sliding apparatus, resulting in a reduction of manufacturing costs.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a main body;

a storage chamber provided in the inside of the main body, wherein a front part of the storage chamber opens;

a storage box accommodated in the storage chamber, and including side surfaces and a bottom surface, wherein the storage box further comprises at least one boss member on the bottom surface;

a guide rail coupled with the storage box, and configured to guide the storage box to be slidingly pushed into and pulled from the storage chamber;

a closing apparatus configured to accumulate an elastic force when the storage box is pulled, and to transfer, when the storage box is pushed, the accumulated elastic force, thereby assisting the pushing of the storage box, wherein the closing apparatus is directly coupled with the bottom surface of the storage box; and at least one coupling member passing through one side of the closing apparatus to be coupled with the boss member, thereby coupling the closing apparatus with the storage box, wherein the boss member provides coupling space to allow the closing apparatus to be directly coupled with the bottom surface.

2. The refrigerator according to claim 1, wherein the boss member comprises at least one boss support connecting an outer surface of the boss member to a lower portion of the storage box so that the at least one coupling member is stably coupled with the storage box.

3. The refrigerator according to claim 1, wherein the boss member is injection-molded with the bottom surface.

4. The refrigerator according to claim 1, wherein the guide rail comprises:

a cover rail fixed at both side walls of the storage chamber, and a sliding rail slidingly moving along the cover rail.

5. The refrigerator according to claim 4, wherein:

the sliding rail comprises a coupling protrusion at one end, and the coupling protrusion protrudes upward in order to couple the storage box with the sliding rail.

6. The refrigerator according to claim 5, wherein:

the storage box further comprises at least one coupling groove at one side, and the coupling protrusion is inserted into the at least one coupling groove so that the storage box is coupled with the sliding rail.

7. The refrigerator according to claim 1, further comprising a coupling portion disposed at both side walls of the storage chamber, and configured to couple the guide rail with the storage chamber, wherein the coupling portion is integrated into the storage chamber such that the guide rail is slidingly inserted on the coupling portion.

8. The refrigerator according to claim 7, wherein the guide rail further comprises a fixing hole into which a fixing member is inserted so that the guide rail is inserted on the coupling portion and then fixed at the coupling portion by the fixing member.

9. The refrigerator according to claim 1, wherein the closing apparatus comprises an oil damper configured to absorb an impact generated by an elastic force when the storage box is pushed.

10. The refrigerator according to claim 9, wherein the closing apparatus further comprises:

a case forming an outer appearance of the closing apparatus, a slider configured to perform a reciprocating motion in the inside of the case, a rotator rotatably coupled with the slider, and an elastic member connected to the slider and the case, respectively, at both ends.

11. The refrigerator according to claim 10, wherein the closing apparatus further comprises a guide rail in the inside of the case, wherein the guide rail comprises:

a linear path configured to guide the rotator to perform a reciprocating motion, and a catching portion formed at one end of the linear path so that the rotator rotates to be fixed at the catching portion.

12. The refrigerator according to claim 10, wherein:

the guide rail further comprises a catching member, and the rotator is caught by the catching member when the storage box is pushed and pulled so as to perform a reciprocating motion in a direction in which the storage box moves.

13. A refrigerator comprising:

a main body;

a storage chamber provided in the inside of the main body, wherein a front part of the storage chamber opens;

a storage box accommodated in the storage chamber, and including at least one boss member;

a guide rail configured to guide the storage box to be slidingly pushed into or pulled from the storage chamber;

a closing apparatus configured to accumulate an elastic force when the storage box is pulled, and to transfer, when the storage box is pushed, the elastic force in a direction in which the storage box is pushed; and at least one coupling member configured to pass through one side of the closing apparatus to be coupled with the boss member.

14. The refrigerator according to claim 13, wherein:

the storage box further comprises a bottom surface forming a bottom of the storage box, and the at least one boss member is integrated into the bottom surface.

15. The refrigerator according to claim 13, wherein the at least one coupling member is screw-coupled with the boss member to thereby couple the closing apparatus with the storage box.

16. A refrigerator comprising:

a main body;

a storage chamber provided in the inside of the main body, wherein a front part of the storage chamber opens;

a storage box accommodated in the storage chamber, and including side surfaces and a bottom surface;

a guide rail coupled with the storage chamber, and configured to guide the storage box to be slidingly pushed into and pulled from the storage chamber;

a closing apparatus configured to accumulate an elastic force when the storage box is pulled, and to transfer, when the storage box is pushed, the elastic force in a direction in which the storage box is pushed, thereby assisting the pushing of the storage box;

at least one boss member integrated into the bottom surface; and at least one coupling member configured to pass through one side of the closing apparatus to be coupled with the boss member, wherein the at least one coupling member is coupled with the boss member so that the closing apparatus is directly coupled with the bottom surface of the storage box.

* * * * *